US009567719B2

(12) United States Patent
Doyle et al.

(10) Patent No.: US 9,567,719 B2
(45) Date of Patent: Feb. 14, 2017

(54) AQUATIC LIFE AND DEBRIS COLLECTION DEVICE FOR A WATER SCREEN

(71) Applicant: Laitram, L.L.C., Harahan, LA (US)

(72) Inventors: Ross Doyle, Mandeville, LA (US); Timothy A. Woodrow, New Orleans, LA (US); Mitchell G. Pansano, Jr., Harahan, LA (US); John C. Hawkins, Jr., Mandeville, LA (US)

(73) Assignee: Laitram, L.L.C., Harahan, LA (US)

( * ) Notice: Subject to any disclaimer, the term of this patent is extended or adjusted under 35 U.S.C. 154(b) by 988 days.

(21) Appl. No.: 13/856,247

(22) Filed: Apr. 3, 2013

(65) Prior Publication Data

US 2014/0299528 A1 Oct. 9, 2014

(51) Int. Cl.
*E02B 1/00* (2006.01)
*E02B 8/02* (2006.01)

(52) U.S. Cl.
CPC ..... *E02B 1/006* (2013.01); *E02B 8/026* (2013.01)

(58) Field of Classification Search
None
See application file for complete search history.

(56) References Cited

U.S. PATENT DOCUMENTS 1,208,655 A * 12/1916 Reynolds ..... B01D 33/0058 210/160
1,346,881 A * 7/1920 Dixon ..... E02B 1/006 210/156
1,420,508 A * 6/1922 Walker ..... E02B 1/006 210/157
1,426,217 A * 8/1922 Roddy ..... 210/160
1,451,394 A * 4/1923 Hurst ..... E02B 1/006 210/162
1,486,034 A * 3/1924 Rhudy ..... E02B 1/006 210/157

(Continued)

FOREIGN PATENT DOCUMENTS

EP 2981652 A2 * 2/2016 ..... E02B 1/006
WO WO 2014165379 A2 * 10/2014 ..... E02B 1/006

OTHER PUBLICATIONS

IPER for PCT/US2014/031959 dated Oct. 6, 2015; prepared by Mineko Mohri; seven pages.*

(Continued)

*Primary Examiner* — Robert James Popovics
(74) *Attorney, Agent, or Firm* — Catherine M. Bishop

(57) ABSTRACT

A collection device for aquatic life and debris for a traveling water screen. The collection device allows sharing of water provided from a high pressure nozzle while shielding aquatic life from a high pressure spray produced by the high pressure nozzle. The collection device enables separate collection of items exposed to a high pressure spray and items protected from a high pressure spray while reducing water costs. The collection device includes a first compartment for collecting aquatic life collected by a water screen and a second compartment for collecting debris collected by the water screen. A shield dissipates or blocks a high pressure spray directed into the second compartment from entering the first compartment. A filter allows fluid to flow from the second compartment into the first compartment while blocking aquatic life in the first compartment from entering the second compartment.

14 Claims, 14 Drawing Sheets

(56) References Cited

U.S. PATENT DOCUMENTS 1,493,405 A * 5/1924 Tuckfield ..... E02B 1/006 210/106
1,559,535 A * 10/1925 Roddy ..... B01D 33/0058 210/160
1,579,105 A * 3/1926 Green ..... E02B 8/085 198/704
1,658,875 A * 2/1928 Lewis ..... E02B 1/006 210/156
1,692,451 A * 11/1928 Kinney ..... E02B 1/006 210/156
1,732,649 A * 10/1929 Hobart ..... B01D 33/0058 210/160
1,781,223 A * 11/1930 Gary ..... B01D 33/0058 210/160
1,799,457 A * 4/1931 Cuttle ..... E02B 1/006 210/162
1,815,137 A * 7/1931 Bleyer ..... B01D 33/0058 210/160
1,856,381 A * 5/1932 Gary ..... 210/160
1,874,736 A * 8/1932 Bleyer ..... B01D 33/0058 198/643
1,875,790 A * 9/1932 Willis ..... E02B 1/006 210/156
1,903,627 A * 4/1933 Koch ..... E02B 8/085 405/82
1,910,860 A * 5/1933 Sayers ..... B01D 33/0058 210/160
1,913,303 A * 6/1933 Bleyer ..... B01D 33/0058 198/709
1,925,251 A * 9/1933 Hobart ..... B01D 33/0058 210/160
1,942,381 A * 1/1934 Benesh ..... B01D 33/0058 210/160
1,947,752 A * 2/1934 Benesh ..... B01D 33/0058 134/182
1,963,460 A * 6/1934 Bleyer ..... B01D 33/0058 210/160
2,056,445 A * 10/1936 Damman ..... E02B 1/006 210/157
2,074,407 A * 3/1937 Lowe ..... A01K 69/00 210/157
2,095,504 A * 10/1937 Kesti ..... A01K 69/00 210/160
2,162,325 A * 6/1939 Briles ..... E02B 1/006 210/156
2,198,943 A * 4/1940 Lowe ..... E02B 1/006 210/156
2,309,472 A * 1/1943 Morton ..... E02B 1/006 210/156
2,428,757 A * 10/1947 Lind ..... B65G 17/42 198/701
2,804,209 A * 8/1957 Eastling ..... B01D 33/0058 210/158
2,851,162 A * 9/1958 Bleyer ..... E02B 8/026 210/158
2,899,062 A * 8/1959 Heacock ..... B01D 33/333 210/158
3,093,578 A * 6/1963 Hofmeister ..... B01D 33/0058 210/160
3,458,046 A * 7/1969 Passavant ..... B01D 33/333 210/160
3,802,565 A * 4/1974 Hughes ..... B01D 35/28 210/158
3,843,520 A * 10/1974 Bottorf ..... B01D 35/05 210/161
3,850,804 A * 11/1974 Taylor ..... B01D 33/333 198/701
3,868,324 A * 2/1975 Taylor ..... B01D 33/0058 210/158
4,040,952 A * 8/1977 Jopp ..... B01D 33/333 198/848
4,064,048 A * 12/1977 Downs ..... A01K 61/00 210/160
4,169,792 A * 10/1979 Dovel ..... B01D 33/073 210/108
4,176,984 A * 12/1979 Sommers ..... E02B 8/085 119/204
4,186,091 A * 1/1980 Sutton ..... B01D 33/0058 210/158
4,199,453 A * 4/1980 McCawley ..... B01D 33/0006 210/160
4,302,331 A * 11/1981 Condit, Jr. ..... B01D 33/327 198/713
4,415,462 A * 11/1983 Finch ..... E02B 5/08 210/162
4,447,323 A * 5/1984 Jackson ..... E02B 8/026 210/158
4,447,324 A * 5/1984 Jackson ..... B01D 33/0087 210/159
4,518,494 A * 5/1985 Jackson ..... E02B 8/026 210/158
4,541,930 A * 9/1985 Heidler ..... E02B 8/085 210/161
4,582,601 A * 4/1986 Strow ..... B01D 33/0058 210/161
4,676,893 A * 6/1987 Travade ..... B01D 33/067 119/219
4,740,105 A * 4/1988 Wollander ..... E02B 8/08 405/81
4,812,231 A * 3/1989 Wiesemann ..... B01D 33/04 209/307
4,892,652 A * 1/1990 Rudy ..... B01D 33/333 210/160
4,919,346 A * 4/1990 Chambers, Sr. ..... B07B 1/10 210/160
4,929,122 A * 5/1990 Yoas ..... E02B 8/085 210/154
4,935,131 A * 6/1990 Pindar ..... B01D 33/333 210/160
5,060,872 A * 10/1991 Chambers, Sr. ..... B07B 1/10 210/160
5,061,380 A * 10/1991 Stevenson ..... B01D 33/275 198/608
5,094,751 A * 3/1992 Ramsey ..... B01D 29/114 210/408
5,116,490 A * 5/1992 Fontenot ..... B01D 33/15 209/271
5,242,583 A * 9/1993 Thomas ..... B01D 33/056 160/369
5,326,460 A * 7/1994 Cheesman ..... B01D 33/333 140/71 R
5,415,766 A * 5/1995 Quick ..... B01D 33/333 210/160
5,419,832 A * 5/1995 Heinen ..... E02B 8/026 210/160
5,501,793 A * 3/1996 Cheesman ..... B01D 33/333 210/160
5,558,462 A * 9/1996 O'Haver ..... E02B 1/006 210/242.1
5,653,874 A * 8/1997 Berry, III ..... B01D 29/05 210/159
5,685,978 A * 11/1997 Petrick ..... B01D 29/03 209/249
6,187,184 B1 2/2001 Reetz et al.
6,270,684 B1 * 8/2001 Schloss ..... B01D 33/073 210/157
6,863,807 B2 * 3/2005 Crawford, III ..... E02B 8/02 210/170.09
7,048,850 B2 5/2006 DePaso et al.
7,201,842 B2 * 4/2007 Kiefer ..... B01D 29/085 210/162
7,300,572 B2 11/2007 DePaso et al.
7,347,933 B2 * 3/2008 Berry, III ..... B01D 33/073 210/107
7,393,451 B2 7/2008 Wunsch et al.
7,510,650 B2 * 3/2009 Wilcher ..... B01D 33/333 210/160

(56) References Cited

U.S. PATENT DOCUMENTS

| | | | | |
|---|---|---|---|---|
| 7,575,113 | B2 | 8/2009 | Sedlacek et al. | |
| 7,575,677 | B1 * | 8/2009 | Barnes | B01D 29/111 210/170.01 |
| 7,722,762 | B2 | 5/2010 | Zubair | |
| 7,776,212 | B2 | 8/2010 | Wunsch et al. | |
| 7,950,527 | B2 * | 5/2011 | Osborne | B01D 29/114 210/172.3 |
| 8,092,674 | B2 | 1/2012 | Heil | |
| 8,282,836 | B2 * | 10/2012 | Feher | E02B 9/04 210/159 |
| 8,292,089 | B2 * | 10/2012 | Osborne | B01D 29/114 210/170.09 |
| 8,297,448 | B2 * | 10/2012 | Watson | E02B 5/08 210/170.09 |
| 8,753,506 | B2 * | 6/2014 | Kim | B01D 29/445 210/155 |
| 9,068,311 | B2 * | 6/2015 | Greif | E02B 8/085 |
| 9,206,572 | B2 * | 12/2015 | Heil | B01D 33/333 |
| 9,255,372 | B2 * | 2/2016 | Whitaker | E02B 5/085 |
| 9,399,858 | B2 * | 7/2016 | Maxson | B01D 35/02 |
| 9,416,920 | B2 * | 8/2016 | Veinbergs | F17D 1/08 |
| 2002/0127060 | A1 | 9/2002 | Bryan | |
| 2010/0224570 | A1 * | 9/2010 | Feher | E02B 9/04 210/747.5 |
| 2011/0139692 | A1 * | 6/2011 | Heil | B01D 33/333 210/158 |
| 2011/0146802 | A1 * | 6/2011 | Feher | E02B 1/006 137/1 |
| 2013/0032515 | A1 * | 2/2013 | Carayon | B01D 33/073 210/158 |
| 2014/0299528 | A1 * | 10/2014 | Doyle | E02B 8/026 210/170.09 |

OTHER PUBLICATIONS

Evaluation of Impingement Mortality Reducing Technologies for Harbor and Haynes Generating Stations; Final Report Jul. 2014, Electric Power Research Institute (EPRI), 123 pages.*

International Search Report and Written Opinion of the International Searching Authority, PCT/US2014/031959, mailed Sep. 29, 2014, European Patent Office, Rijswijk, NL.

Intralox Water Screen; Installed Dec. 2006 at the E.F. Barrett Power Station, Island Park, New York (see attached Figure).

* cited by examiner

FIG. 12
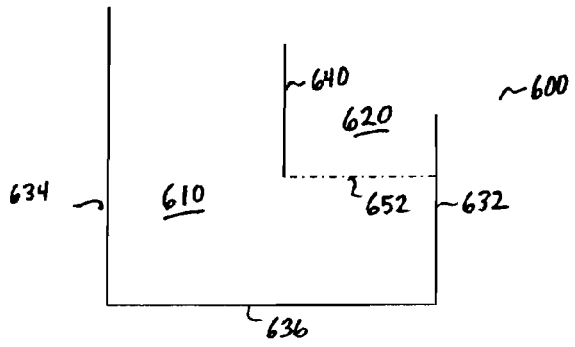
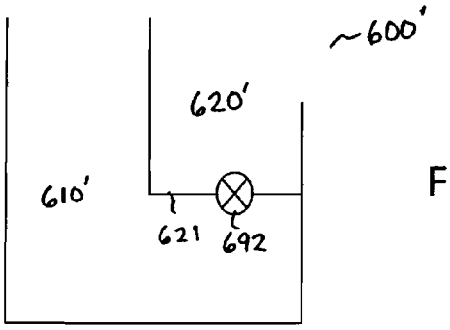
FIG. 13

AQUATIC LIFE AND DEBRIS COLLECTION DEVICE FOR A WATER SCREEN

BACKGROUND

The present invention relates generally to water screens and, more particularly, to traveling water screen systems with collection devices for collecting aquatic life and debris trapped by a water screen.

Water drawn into an industrial plant from a lake or river must be filtered to prevent debris from fouling equipment and causing damage and to protect aquatic life in the lake or river from damage. Traveling water screens are used to filter out and remove debris and aquatic life from an influent channel before the debris can enter the plant or fish impinged on the upstream face of the screen die. A typical traveling water screen comprises a motor-driven screen, such as a foraminous conveyor belt, extending laterally across the width of the channel and vertically from the bottom of the channel to a height above the level of the water to ensure that all the water flowing in the channel passes through the screen. The water screen travels a circuitous path around a motor-driven head shaft above the level of the water and a lower idle shaft in a boot section of the water screen at the bottom of the channel. The screen travels upward along the upstream portion of its circuitous path and downward along the downstream portion. A series of lift elements, such as baskets, scoops, or flights, extending outward of the screen at periodic intervals along its length lift debris or fish trapped on the upward-moving upstream portion of the water screen out of the channel for disposal in the case of debris and safe transit in the case of fish.

A variety of different types of traveling water screen systems is known, including "through-flow pattern" ("transverse flow"), "out-to-in flow pattern" ("dual flow") and "in-to-out flow pattern" ("center flow") types. In the "through-flow pattern" type, the screen panels are arranged transversely to the direction of flow of the sluice channel and the screen panels that move downwardly are arranged behind the upwardly moving screen panels in the direction of flow. In the "out-to-in flow pattern" and "in-to-out flow pattern" types of construction, the screen panels are arranged in the direction of flow of the sluice channel. In the "out-to-in flow pattern" type of construction, the contaminated water side is the outside of the upwardly and downwardly moving sections and the clean water side is the interior space between the two sections; the opposite is the case for the "in-to-out flow pattern" type of construction.

For fish handling water screen applications, it is current practice to have a dedicated collection trough for fish and a separate collection trough for debris, as shown in U.S. Pat. No. 8,092,674, the contents of which are incorporated herein by reference. The use of separate collection troughs prevents damage to fish by the high pressure spray water used to clean debris from the water screen.

FIG. 1 shows another water screen system of the prior art 10, comprising a water screen 11 driven by a sprocket 14 and having fish buckets 13 for collecting aquatic life. The water screen includes a trough 12 for collecting the aquatic life and debris trapped by the water screen. The trough 12 comprises a single trough for collecting and combining both aquatic life and debris from the water screen, and a deflector 16 suspended in the trough. A high pressure spray nozzle 18 directs high pressure water through the water screen 11 to push debris trapped by the water screen into the trough 12. A lower pressure spray nozzle 19 provides water for aquatic life dumped by the fish buckets. The deflector 16 blocks the high pressure spray from harming fish falling into the trough from the fish buckets 13. Water, fish, debris and other collected items freely flow below the deflector 16 across the width of the trough 12 and are collected together.

SUMMARY

An embodiment of the present invention provides a collection device for a water screen. The collection device separately collects aquatic life and debris from the water screen in separate compartments, while allowing water to flow between the two compartments. The contents of each compartment may be separately collected for analysis or reporting purposes. The collection device prevents aquatic life in one compartment from entering another compartment.

According to one aspect, a collection device for aquatic life and debris trapped by a water screen comprises a first compartment for collecting aquatic life trapped by the water screen, a second compartment for collecting debris trapped by the water screen, the second compartment exposed to a high pressure spray from a high pressure spray emitter, a shield for shielding the first compartment from the high pressure spray and a filter for allowing fluid flow from the second compartment to the first compartment while preventing aquatic life collected by the first compartment from entering the second compartment.

According to another aspect, a collection device for aquatic life and debris trapped by a water screen comprises a first side wall, a second side wall, a bottom wall extending between the first side wall and the second side wall, a divider extending into a space between the first side wall and the second side wall to define a first compartment and a second compartment and a filter in the divider for allowing the passage of fluid through the divider while preventing the flow of aquatic life through the divider.

According to another aspect, a collection device for aquatic life and debris trapped by a water screen comprises a first compartment for receiving aquatic life trapped by the water screen a second compartment adjacent to the first compartment for receiving debris trapped by the water screen and a divider separating the first compartment from the second compartment. The divider comprises a wall including a plurality of openings for placing the first compartment in fluid communication with the second compartment.

According to a final aspect, a water screen system comprises a traveling water screen including lift elements, a high pressure nozzle for applying a high pressure fluid spray to the water screen to release debris from the water screen and a collection device for collecting aquatic life and debris collected by the water screen. The collection device comprises a first compartment for collecting aquatic life from the lift elements, a second compartment for collecting debris from the water screen released by the high pressure fluid spray, and a filter for allowing fluid flow from the second compartment to the first compartment while preventing aquatic life from entering the second compartment from the first compartment.

BRIEF DESCRIPTION OF THE DRAWINGS

These aspects and features of the invention, as well as its advantages, are explained in more detail in the following description, appended claims, and accompanying drawings, in which:

FIG. 12 is a cross-sectional view of a collection device including a mesh filter in the floor of one compartment for allowing fluid communication between separate compartments of the collection device according to another embodiment of the invention;

FIG. 13 is a side view of a collection device including a valve in the floor of one compartment for allowing fluid to flow from one compartment to another compartment;

DETAILED DESCRIPTION

An embodiment of the present invention provides a collection device for a water screen that allows sharing of water provided from a high pressure nozzle while shielding aquatic life from a high pressure spray produced by the high pressure nozzle. The collection device enables separate collection of items exposed to a high pressure spray and items protected from a high pressure spray while reducing water costs. The invention will be described relative to certain illustrative embodiments. Those skilled in the art will recognize that the invention is not limited to the illustrative embodiments, and that variations may be made.

As used herein, the term "filter" refers to any device that allows passage of fluid in at least a first direction while preventing the passage of aquatic life in a second direction. Examples of suitable filters include mesh, a gate, openings of a certain size, a wire grid, profile bar, a drain, a valve, a pipe, and other devices known in the art.

The word "fish" as used herein includes all aquatic life, including, but not limited to fish, crustaceans and amphibians, as well as the eggs and larvae of fish, crustaceans and amphibians present in the water being filtered by a water screen.

The term "high pressure spray" refers to a spray suitable for removing debris impinged on a water screen, and generally has a pressure greater than about 50 pounds per square inch.

An embodiment of an aquatic life and debris collection device includes a first compartment for collecting aquatic life, usually deposited from a lift element on a water screen, such as a fish bucket. A second compartment collects debris trapped by the water screen. A nozzle or spray header comprising a collection of nozzles directs a high pressure water spray through the water screen to push debris from the water screen into the second compartment. The contents of each compartment can be separately collected and tested. A shield protects the contents of the first compartment from the high pressure spray. A filter allows water to flow from the second compartment into the first compartment while preventing aquatic life from flowing from the first compartment into the second compartment. In this manner, the collection device protects aquatic life while reducing water usage.

Figure 1:
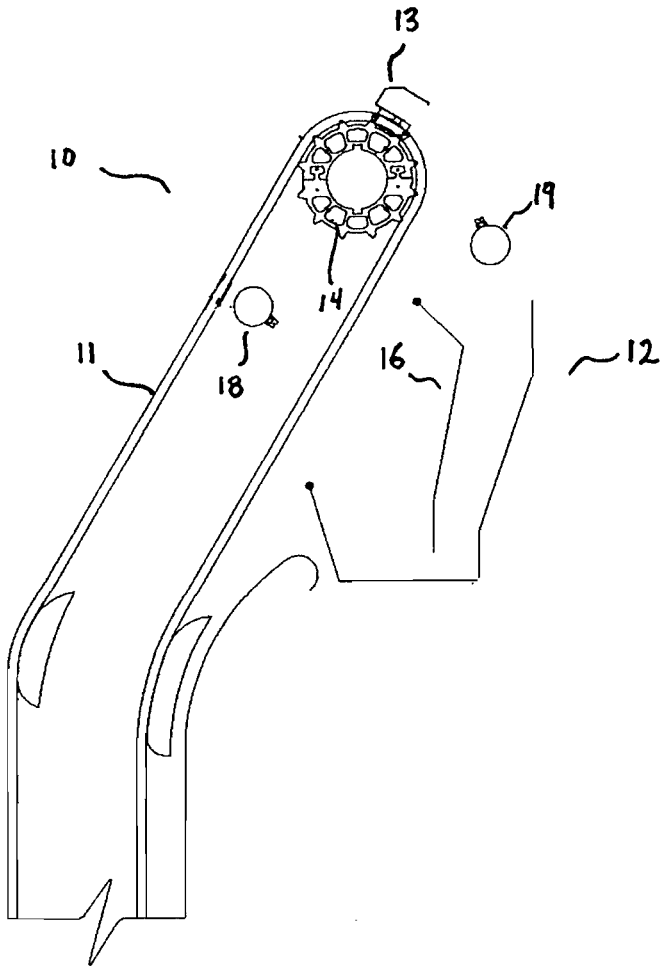
FIG. 1 (PRIOR ART)
FIG. 1 is a side view of a prior water screen including a collection device.
Figure 2A:
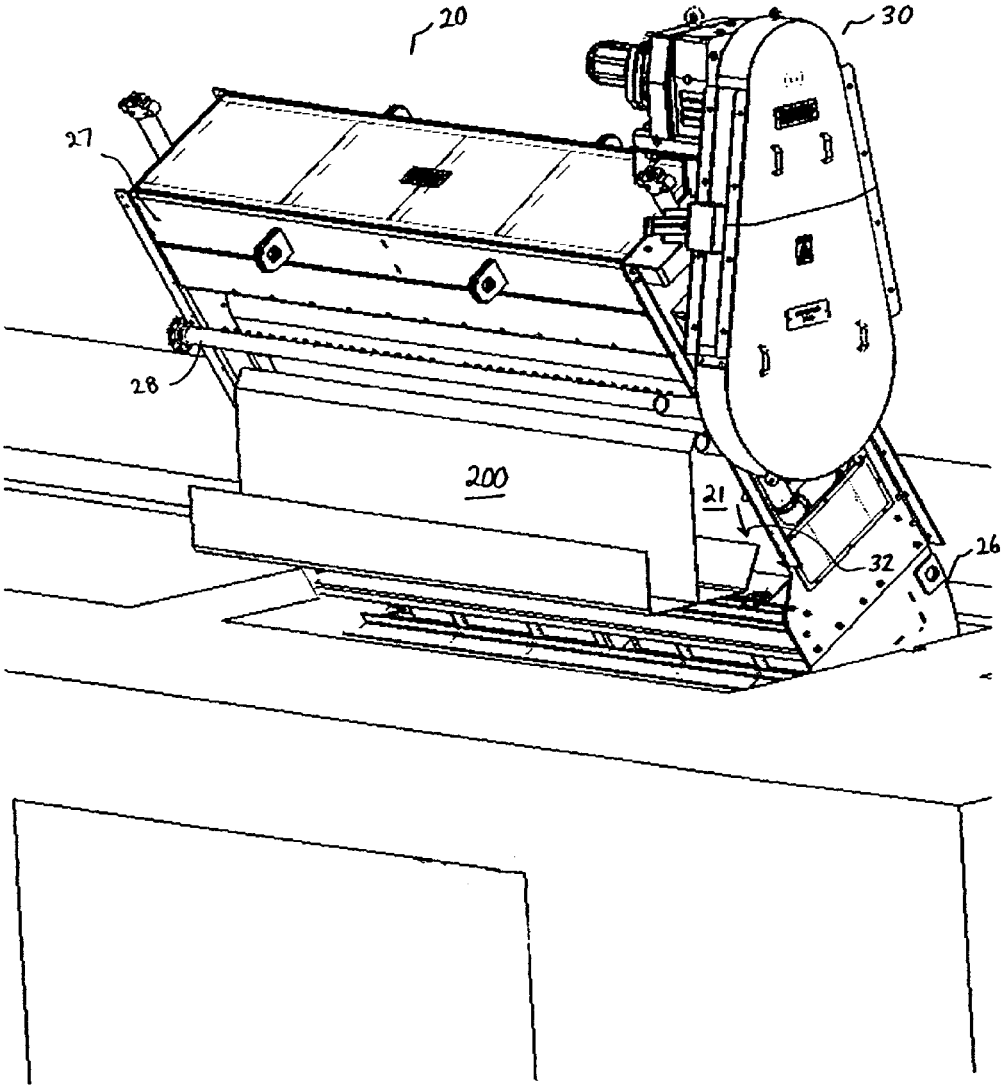
FIG. 2A is an isometric view of a water screen system employing a collection device according to an illustrative embodiment of the invention.
Figure 2B:
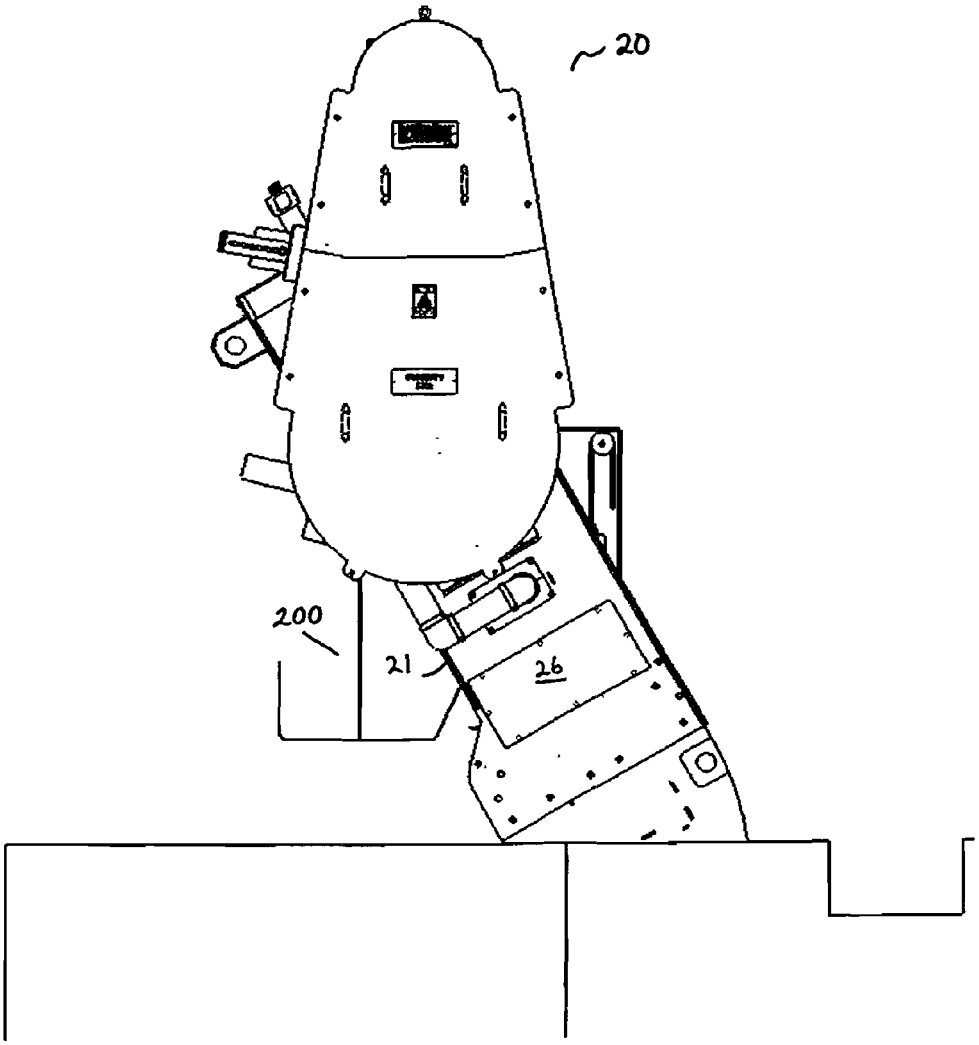
FIG. 2B is a side view of the water screen system of FIG. 2A.
Figure 3A:
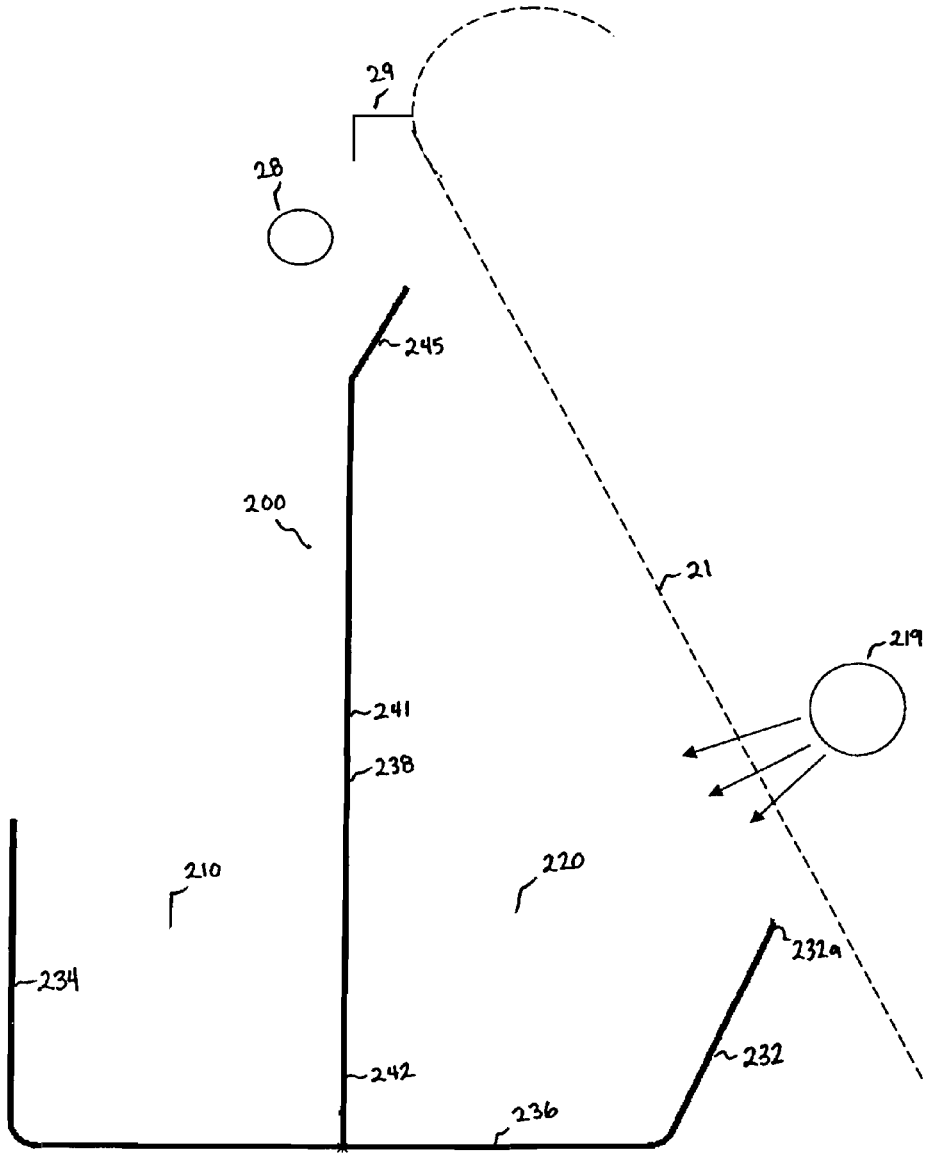
FIG. 3A is a side view of the collection device of FIG. 2A.
Figure 3B:
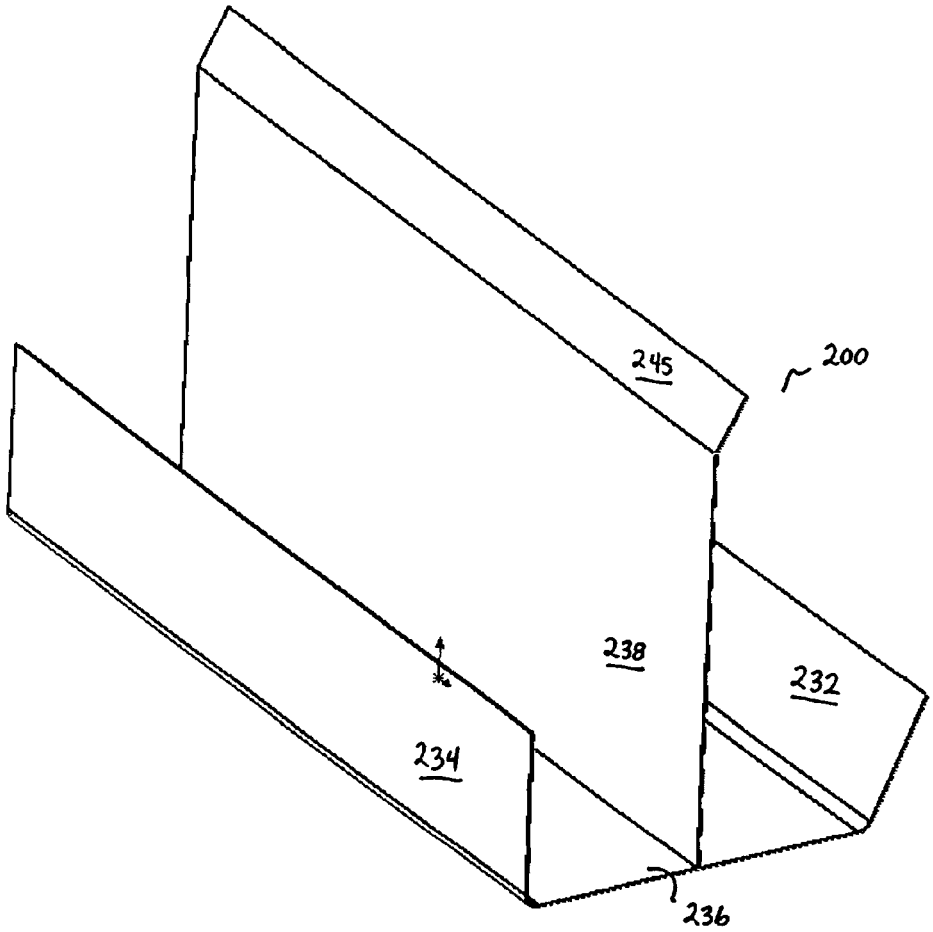
FIG. 3B is an isometric view of the collection device of FIG. 3A.

FIGS. 2A and 2B illustrate a water screen system 20 employing a collection device 200 of an illustrative embodiment of the invention. FIG. 3A is a schematic side view of the collection device, showing the relative placement of the collection device with respect to the water screen 21, and FIG. 3B is an isometric view of the collection device. The illustrative system 20 is a "transverse flow, vertically traveling" water screen, but the collection device 200 may be implemented in any suitable type of system for screening debris and aquatic life. The water screen system 20 includes a vertically traveling water screen 21 in the form of an endless modular conveyor belt loop entrained between upper and lower sprocket sets on drive and idle shafts. The screen includes fish buckets 29 or other lift elements for collecting aquatic life. The system 20 further includes a frame 26 for mounting the water screen 21. The upper sprocket set is housed in a head portion 27.

The illustrative modular plastic conveyor belt 21 is constructed of a series of rows of belt modules. Consecutive rows are joined together in a hinge joint by a hinge pin received in a lateral passageway through interleaved hinge eyes of consecutive rows. Teeth on the sprockets engage drive structure in the inner side of the belt. A drive motor 30 at one end of the belt, illustrated as the upper end, is coupled to the drive shaft to drive the belt in normal operating conditions in the direction given by arrow 32. Alternatively, the belt could be a flat perforated or mesh rubber belt driven between pulleys. Multiple perforations, or openings, make the belt foraminous and suitable for use as a water screen. Examples of suitable belts and buckets for use in a water screen system are described in U.S. Pat. Nos. 7,048,850, 7,300,572, 7,393,451, 7,722,762, 7,776,212, 6,187,184 and 7,575,113 and 8,092,674, which are herein incorporated by reference.

As shown in FIG. 3A, a high pressure spray emitter, such as a nozzle 219, is disposed within the water screen 21 downstream of the head 27 for directing high pressure spray through the water screen to release debris collected by the water screen. An optional low pressure spray emitter 28 is disposed downstream of the head on the outside of the water screen 21 for rinsing the fish buckets 29 and-or adding water to aquatic life dumped by the lift elements into the collection device 200. The low pressure spray emitter 28 generally supplies a spray at a pressure that is less than about 45 pounds per square inch, though the invention is not so limited.

The illustrative collection device 200, illustrated as a double trough, is disposed on the downstream side of the head 27 housing an upper sprocket. However, a collection device of an embodiment of the invention may be located in any suitable location. For example, the collection device may alternatively be located within the water screen for an in-to-outflow type of water screen, such as described in U.S. Pat. No. 8,092,674.

Referring to FIGS. 3A and 3B, the collection device 200 includes a first compartment, illustrated as a first trough 210, for collecting a first set of items, such as aquatic life in water flow, and a second compartment 220 for collecting a second set of items, such as debris in water flow. The illustrative compartments 210, 220 are adjacent, though the invention is not so limited, and the compartments may be nonadjacent to and-or separate from each other. The collection device 200 includes a front wall 232, a rear wall 234, a bottom wall 236 and a dividing wall 238 extending upwards from the bottom wall 236. Preferably, the tip 232*a* of the front wall is close to the water screen 21 so that the second compartment is adjacent to the outside of the water screen. The dividing wall 238 includes a top portion 241 forming a shield for shielding items in the first compartment from a high pressure spray emitted by the high pressure nozzle 219. The illustrative top portion 241 is substantially impervious to fluid flow to shield the items in the first trough 210 from a high pressure spray. A lower portion 242 comprises a filter, embodiments of which are described below, to allow fluid provided by the high pressure nozzle, or otherwise present in the second trough 220, to pass at a lower pressure into the first trough 210. The lower portion 242 is impervious to solids, so that fish, fish eggs or other items are prevented from passing into the second trough 220 from the first trough 210. In this manner, the contents of the first compartment and the second compartment may be separately collected, while ensuring sufficient water supply for promoting the survival of aquatic life collected in the first compartment.

In the illustrative embodiment, the dividing wall 238 includes a bent upper portion 245 to help guide fish from a fish bucket 29 into the first compartment 210. The tip of the bent upper portion 245 may be aligned with the inside edge of the fish bucket to ensure that fish enter the first compartment when dumped from the fish bucket. The walls forming the compartments 210, 220 may be straight, angled, corrugated, curved, serpentine, or have any suitable configuration and are not limited to the illustrative embodiment. The walls may be shaped to promote fluid flow, aquatic life survival or another desired outcome.

A high pressure spray emitted by the nozzle 219 within the water screen 21 releases debris from the water screen. The debris falls into the second compartment 220, along with the water. The shield 241 blocks or dissipates the flow of water from the high pressure nozzle to protect aquatic life dumped into the first compartment 210 from a fish bucket. Water is allowed to flow through the lower portion 242 into the first compartment to reduce the necessity of a separate or high volume water supply for the aquatic life in the first compartment.

The troughs 210, 220 can flow in the same direction or may flow in opposite directions.

Figure 4:
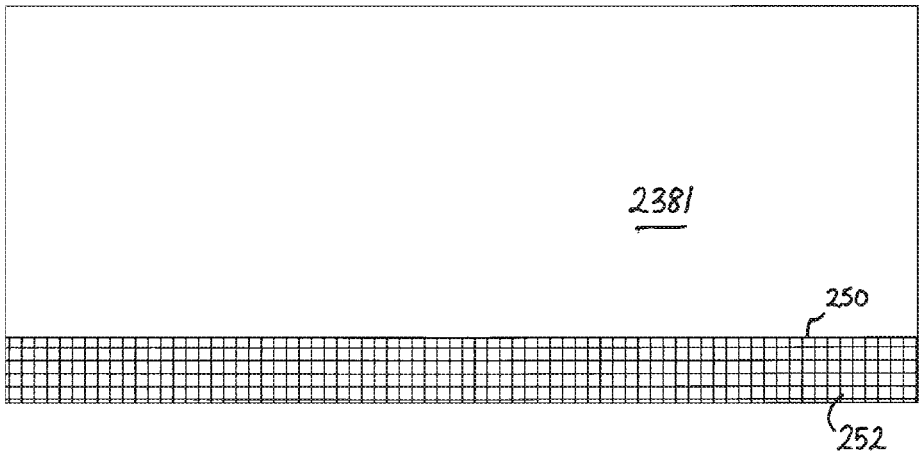
FIG. 4 is a front view of a dividing wall including mesh for a collection device of one embodiment of the invention.

Referring to FIG. 4, in one embodiment, an embodiment of a dividing wall 2381 including a filter for a collection device comprises a window 250 extending along the length of the dividing wall formed of or filled with mesh 252. The mesh 250 may extend to the bottom, or be at an intermediate location of the dividing wall 2381. The mesh may have any density or porosity and may be formed of any material suitable for blocking the passage of aquatic life while allowing the passage of water therethrough. For example, in one embodiment, the mesh is a #8 mesh with openings less than about 3⁄32" to sufficiently block the passage of aquatic life. The upper portion of the dividing wall 2381 blocks or dissipates high pressure spray from damaging aquatic life across the dividing wall 2381.

Figure 5:
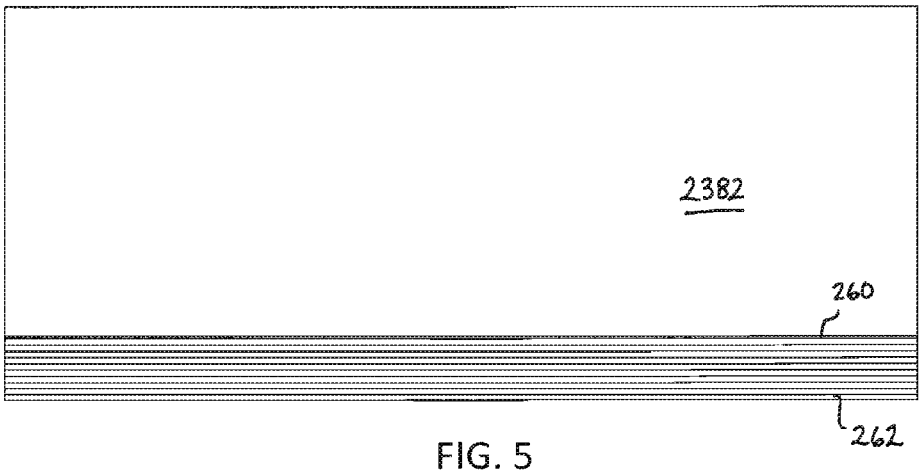
FIG. 5 is a front view of a dividing wall for a collection device according to another embodiment of the invention.

In another embodiment, shown in FIG. 5, a filter in a dividing wall 2832 of a collection device comprises a window 260 filled with profile bar or wedge wire 262 for allowing fluid flow while blocking the passage of aquatic life. The upper portion of the dividing wall 2382 blocks or dissipates high pressure spray from damaging aquatic life across the dividing wall 2382.

Figure 6:
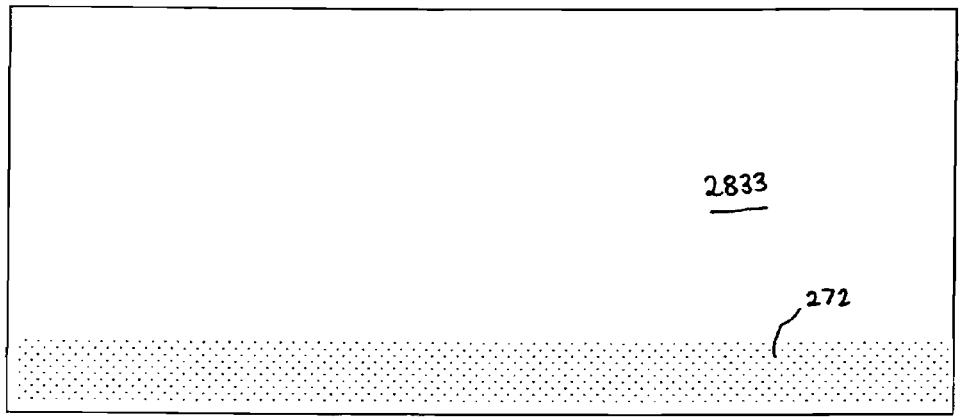
FIG. 6 is a front view of a dividing wall for a collection device according to another embodiment of the invention.

In another embodiment, shown in FIG. 6, the collection device filter may comprise perforations 272 or other openings of any suitable size, shape, density and configuration in the dividing wall 2833 defining first and second compartments for allowing fluid flow therebetween, while blocking the passage of aquatic life. The upper portion of the dividing wall 2383 forms a shield that blocks or dissipates high pressure spray from damaging aquatic life across the dividing wall 2383.

Figure 7:
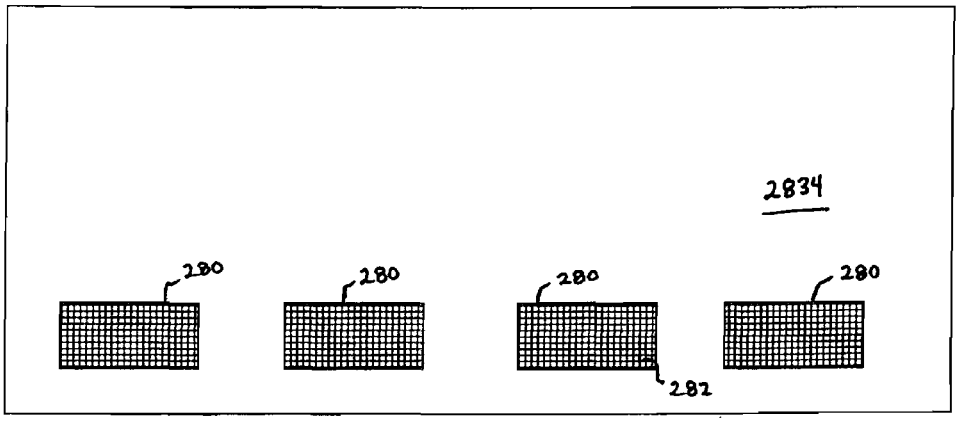
FIG. 7 is a front view of a dividing wall for a collection device according to another embodiment of the invention.

As shown in FIG. 7, the collection device filter may comprise mesh 282 disposed in one or more smaller windows 280 in a dividing wall 2834. The windows 280 may have any suitable size, shape, number or configuration.

Figure 8:
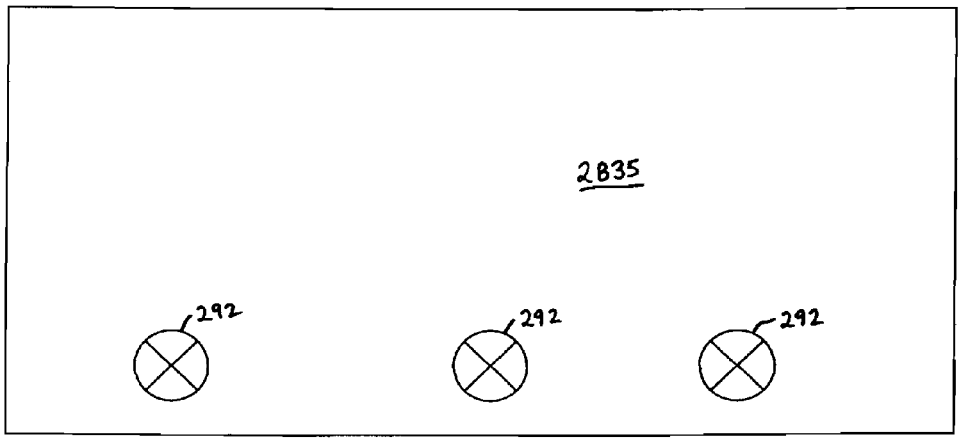
FIG. 8 is a front view of a dividing wall for a collection device including valves according to another embodiment of the invention.

In another embodiment, shown in FIG. 8, the collection device filter may comprise one or more valves 292 disposed in a dividing wall 2835 for allowing fluid flow through the dividing wall 2835 while blocking the passage of aquatic life from the first compartment to the second compartment divided by the dividing wall.

Figure 9:
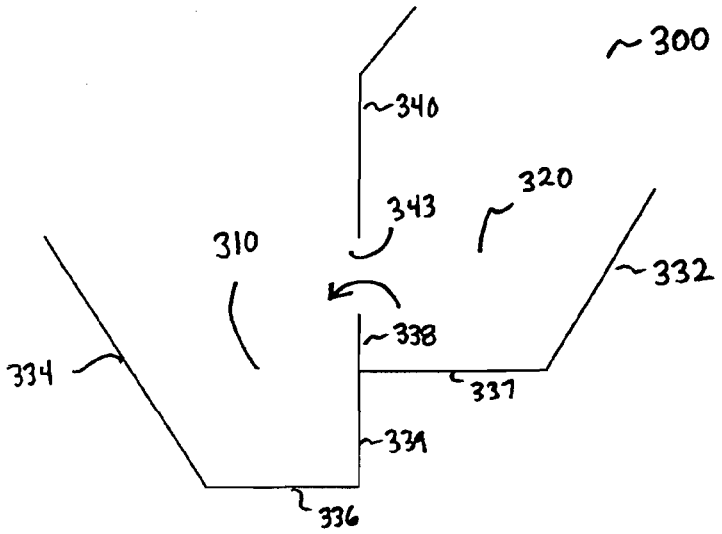
FIG. 9 is a side view of a collection device including separate compartments, a shield and a filter comprising a gate according to another embodiment of the invention.

FIG. 9 is a side view of another embodiment of a collection device 300 suitable for protecting aquatic life while reducing water usage in a water screen system. The collection device 300 includes a front wall 332, a rear wall 334, a first bottom wall 336 intersecting the front wall, a second bottom wall 337 intersecting the rear wall 334, and a dividing wall, illustrated as a lip 338 extending upwards from one of the bottom walls 337. The collection device 300 thus forms two compartments: a first compartment 310, such as a trough, for collecting aquatic life deposited from a fish buckets and a second compartment 320, such as a trough, for collecting debris released from a water screen by a high pressure spray. In the illustrative embodiment, the first bottom wall 336 is lower than the second bottom wall 337 and connected by a connecting wall 339, so that the first compartment 310 is lower than the second compartment 320 to facilitate fluid flow towards the first compartment from the second. A shield 340 extends into the space between the front wall and rear wall to protect the first compartment 310 from high pressure spray directed to the second compartment 320.

The collection device 300 further includes a filter, illustrated as a space 343 formed between the shield 340 and lip 338 that forms a gate to regulate flow between the two compartments. The gate allows water to flow from the second compartment 320 into the first compartment, while preventing aquatic life from flowing from the first compartment into the second compartment.

The walls of the collection device 300 may be straight, angled, curved, corrugated or otherwise configured to promote fluid flow, aquatic life survival or another desired outcome.

Figure 10:
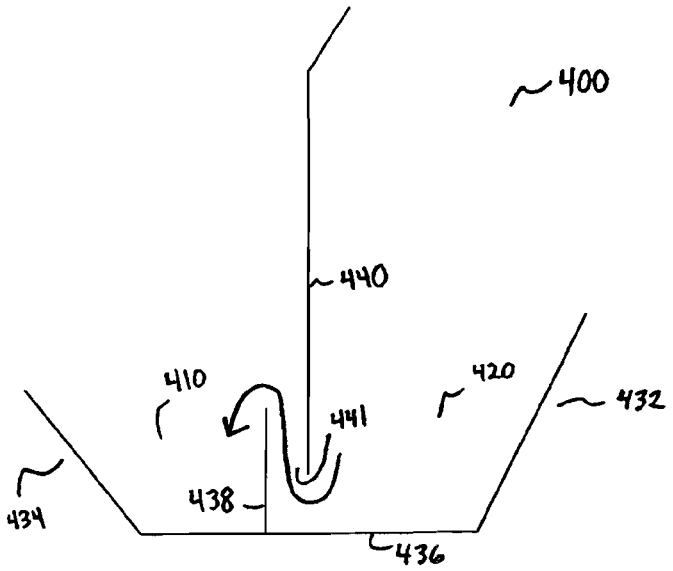
FIG. 10 is a side view of a collection device including separate compartments, a shield and a filter comprising a serpentine passageway according to another embodiment of the invention.

FIG. 10 illustrates another embodiment of a collection device 400 suitable for protecting aquatic life while reducing water usage. The collection device 400 comprises a front wall 432, a rear wall 434, a bottom wall 436, a divider for separating the collection device into a first compartment 410 and a second compartment 420, a shield for shielding the first compartment from a high pressure spray directed to the second compartment and a filter for allowing fluid to flow from the second compartment into the first. In the embodiment of FIG. 10, the divider, shield and filter are formed by a lip 438 extending upwards from the bottom wall 436 and a suspended wall 440 extending downwards between the front wall and rear wall. The lip 438 and suspended wall 440 are offset in the horizontal direction and overlapping in the vertical direction so as to form a serpentine passageway 441. The serpentine passageway is a gate that allows the passage of fluid from the second compartment 420 into the first compartment 410, while preventing fish from passing from the first compartment into the second.

Figure 11A:
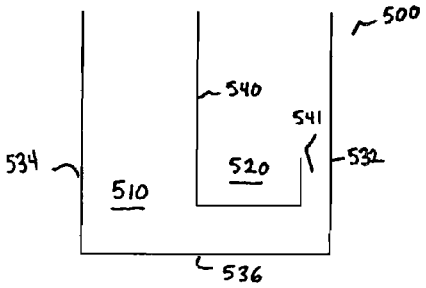
FIG. 11A is a side view of a collection device including a j-shaped shield according to another embodiment of the invention.
Figure 11B:
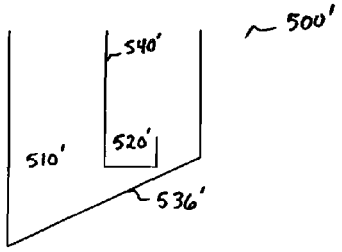
FIG. 11B is a side view of another embodiment of a collection device including a j-shaped shield and angled bottom wall.
Figure 11C:
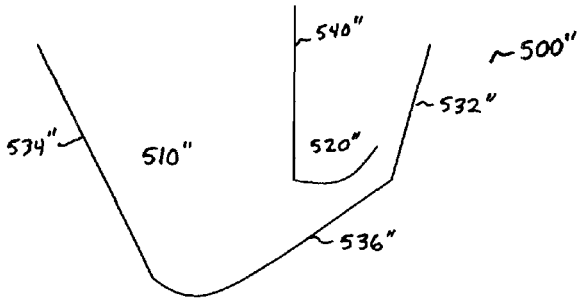
FIG. 11C is a side view of a collection device having a j-shaped shield, curved and angled walls according to another embodiment of the invention.

FIGS. 11A-11C show various embodiments of a collection device including a j-shaped shield that forms a compartment within a larger compartment. In the embodiment of FIG. 11A, a collection device 500 comprises a front wall 532, a rear wall 534 and a bottom wall 536. A j-shaped wall 540 extends into the space between the front wall 532 and rear wall 534 to divide the space into a first compartment 510 for collecting aquatic life and a second compartment 520 in the hook of the "j" for collecting debris. The j-shaped shield 540 protects aquatic life in the first compartment from a high pressure spray in the second compartment. Water can spill from the second compartment 520 into the first via opening 541, which forms a filter, while aquatic life is prevented from passing from the first compartment 510 into the second compartment 520.

As shown in FIG. 11B, the collection device 500' including a j-shaped shield 540' may include an angled bottom wall 536' to facilitate fluid flow into the first compartment 510' and inhibiting the flow of aquatic life from the first compartment 510' to the second compartment 520'.

As shown in FIG. 11C, the front wall 532" and-or rear wall 534" of a collection device may be angled to facilitate deposition of the aquatic life and debris into the compartments 510" and 520". In addition, the second compartment 520" may have a curved bottom formed by the j-shaped shield 540". In the embodiment of FIG. 11C, the bottom wall 536" of the collection device 500 is also curved.

FIG. 12 illustrates another embodiment of a collection device 600 that allows for separate collection of the contents of two compartments, while allowing sharing of water between the two compartments. The collection device 600 comprises a front wall 632, rear wall 634 and bottom wall 636. A shield 640, comprising a wall, extends into the space between the front wall 632 and rear wall 634. Together with a filter, illustrates a mesh 652 extending between the shield 640 and the front wall 632, the shield 640 forms a separate first compartment 610 and second compartment 620. The filter 652 defines at least a portion of the floor of the second compartment 620. The first compartment 610 collects aquatic life from lift elements of an associated water screen and the second compartment 620 collects debris pushed from the water screen by a high pressure spray. The shield 640 protects aquatic life from the high pressure spray. Water passes from the second compartment 620 into the first compartment through the mesh filter 652.

In another embodiment, shown in FIG. 13, a collection device 600' includes a valve 692 or other suitable device forming a filter in the floor 621 of the second compartment 620' dividing a first compartment 610' from a second compartment 620'.

Figure 14:
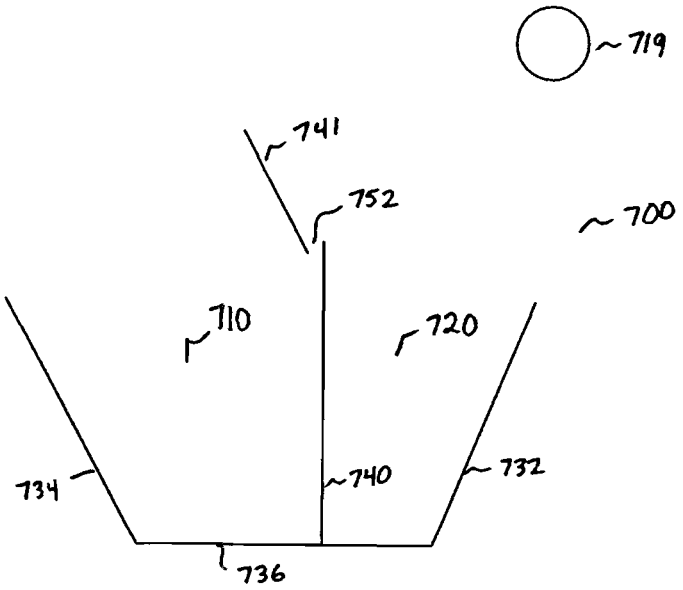
FIG. 14 is a side view of a collection device including a dividing wall, a deflecting shield and a gate for allowing fluid to pass into one compartment from another.

FIG. 14 illustrates another embodiment of a collection device 700 of an embodiment of the invention. The collection device 700 includes a first compartment 710 for collecting aquatic life, and a second compartment for collecting debris from a water screen. The compartments are formed by a front wall 732, bottom wall 736, rear wall 734 and central dividing wall 740 extending from the bottom wall 736. A deflecting wall 741 deflects high pressure spray directed into the second compartment 720 from a nozzle 719 to form a shield. The deflecting wall 741 and dividing wall 740 form a gate 752 to allow the passage of water, at a reduced pressure level, into the first compartment 710. The gate 752 and dividing wall 740 prevent aquatic life from passing from the first compartment 710 into the second compartment 720. Aquatic life can be collected from the first compartment 710 separately from debris collected from the second compartment 720.

In addition to the gate 752, the collection device 700 may include another type of filter for allowing the sharing of water between the two compartments 710, 710.

Figure 15A:
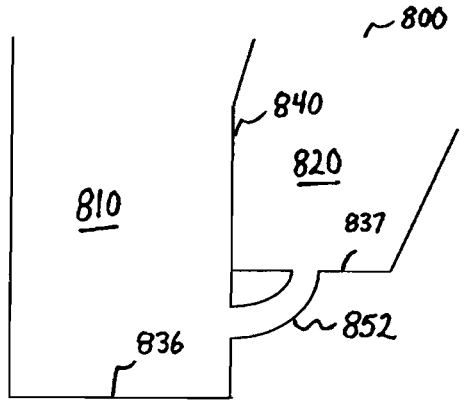
FIG. 15A is a side view of a collection device including a filter comprising a pipe.
Figure 15B:
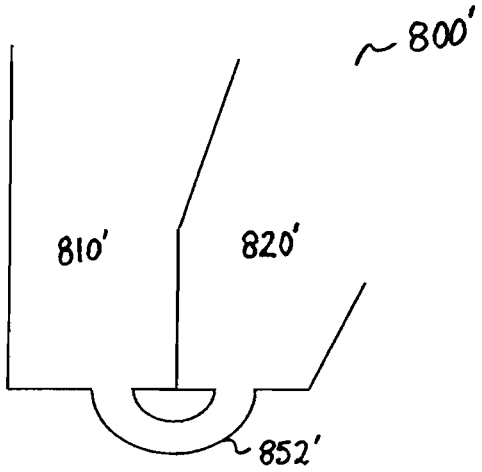
FIG. 15B is a side view of a collection device including a filter comprising a pipe according to another embodiment of the invention.

FIGS. 15A and 15B illustrate alternative embodiments of a collection device including a filter. FIG. 15A shows a collection device 800 comprising a first compartment 810, a second compartment 820 and a filter 852 comprising a pipe extending from the bottom of the second compartment 820 and connecting to the first compartment 810. The bottom wall 836 of the first compartment 810 is lower than bottom wall 837 of the second compartment 820 to facilitate fluid flow from the second compartment into the first, while preventing or limiting the flow of aquatic life from the first compartment into the second compartment. The illustrative pipe 852 is a simple link between the two compartments 810, 820 allowing water to seek its own level. The pipe could have any suitable configuration. In addition, the filter may comprise multiple pipes connecting the compartments. The pipe 852 may also include a secondary filter, such as a valve, mesh, screen or other device to block the flow of items, such as aquatic life and debris, through the pipe 852. The pipe 852 may also be shaped in a P-Trap style configuration to ensure that the water does not equalize past a certain point, thereby maintaining a certain water level in at least one compartment.

A shield, comprising a dividing wall 840, extends between the first compartment 810 and the second compartment 820.

Referring to FIG. 15B, the pipe 852' forming a filter in a collection device 800' may extend between the bottoms of the first compartment 810' and second compartment 820'. In the embodiment of FIG. 15B, the compartments 810' and 820' are level with each other, though the invention is not so limited.

Figure 16A:
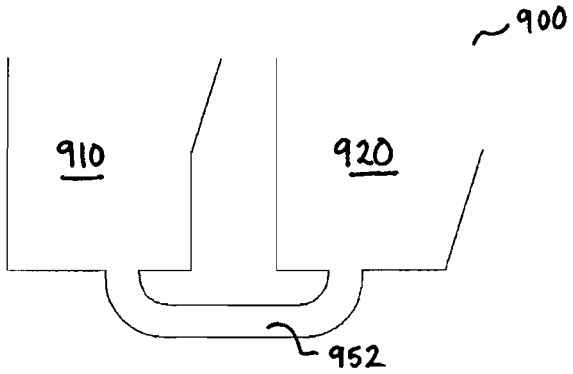
FIG. 16A is a side view of a collection device including nonadjacent compartments connected by a filter according to another embodiment of the invention.
Figure 16B:
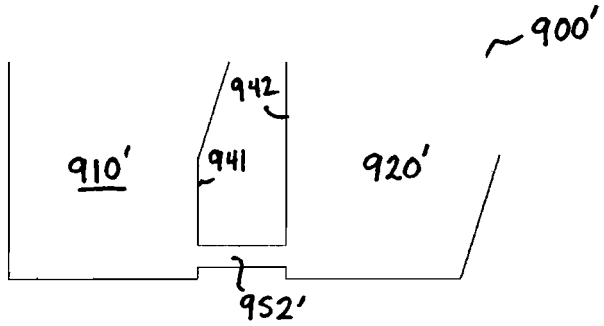
FIG. 16B is a side view of another collection device including nonadjacent compartments connected by a filter.

FIGS. 16A and 16B illustrate alternate embodiments of a collection device including a filter. In FIG. 16A, a collection device 900 comprises a first compartment 910, which may be a trough, and a second compartment 920, which may also be a trough, separate from the first compartment. The first compartment 910 and second compartment 920 are not adjacent, and have separate side walls spaced from each other. The contents of the first compartment 910 are thus protected from a high pressure spray directed into the second compartment 920. A filter, illustrated as a pipe 952, extends between and connects compartments, allowing fluid to flow from the second compartment into the first, while preventing aquatic life from passing from the first compartment into the second compartment. The pipe may include a secondary filter, such as a valve, screen, mesh or other device. The illustrative pipe 952 extends below the compartments and connects the floors of the compartment, but the pipe 952 could be in any suitable location. For example, as shown in FIG. 16B, a collection device 900' may comprise a pipe 952' extending between and connecting interior side walls of two compartments 910' and 920'.

The filter may be adjustable to vary the flow of water or another fluid from the second compartment to the first compartment in a collection device.

As these few examples suggest, the scope of the invention is meant to be defined by the claims and not limited to the details of the described versions.

What is claimed is:

1. A water screen system for collecting aquatic life and debris, comprising:

a traveling water screen driven by a sprocket at a head portion and including lift elements for collecting aquatic life;

a high pressure spray emitter downstream of the head portion for directing high pressure spray through the water screen to release debris collected by the water screen; and a collection device downstream of the head portion for aquatic life and debris trapped by a water screen, the collection device comprising a first compartment positioned to align with a lift element for collecting aquatic life trapped by the water screen;

a second compartment adjacent to the water screen for collecting debris trapped by the water screen, the second compartment exposed to a high pressure spray from the high pressure spray emitter;

a shield for shielding the first compartment from the high pressure spray; and a mesh filter for allowing fluid flow from the second compartment to the first compartment while preventing aquatic life collected by the first compartment from entering the second compartment.

2. The water screen system of claim 1, wherein the first compartment comprises a trough and the second compartment comprises a trough.

3. The water screen system of claim 1, wherein the collection device includes a front wall, a rear wall, a bottom wall and a dividing wall extending from the bottom wall between the front wall and rear wall to define the first compartment and second compartment.

4. A water screen system for collecting aquatic life and debris, comprising:

a traveling water screen driven by a sprocket at a head portion and including lift elements for collecting aquatic life;

a high pressure spray emitter downstream of the head portion for directing high pressure spray through the water screen to release debris collected by the water screen; and a collection device downstream of the head portion for aquatic life and debris trapped by a water screen, the collection device comprising a first side wall adjacent to the water screen;

a second side wall;

a bottom wall extending between the first side wall and the second side wall;

a divider extending into a space between the first side wall and the second side wall to define a first compartment and a second compartment, the divider having an upper tip aligned with an inside edge of a lift element; and a filter in the divider for allowing the passage of fluid through the divider while preventing the flow of aquatic life through the divider, the filter including openings that are less than about 3/32" to block the passage of aquatic life.

5. The water screen system of claim 4, wherein the divider includes an upper portion that is substantially impervious to fluid flow and a lower portion comprising the filter.

6. The water screen system of claim 4, wherein the first compartment and the second compartment are troughs.

7. The water screen system of claim 4, wherein the filter comprises one of: mesh, a valve, profile bar, a gate, a pipe and perforations in the divider.

8. The water screen system of claim 4, wherein the divider blocks high pressure spray directed into the second compartment from entering the first compartment.

9. The water screen system of claim 4, further comprising a shield for blocking high pressure spray directed into the second compartment from entering the first compartment.

10. A water screen system for collecting aquatic life and debris, comprising:

a traveling water screen driven by a sprocket at a head portion and including lift elements for collecting aquatic life;

a high pressure spray emitter downstream of the head portion for directing high pressure spray through the water screen to release debris collected by the water screen; and a collection device downstream of the head portion for aquatic life and debris trapped by a water screen, the collection device comprising a first compartment for receiving aquatic life trapped by the water screen;

a second compartment adjacent to the first compartment for receiving debris trapped by the water screen; and a divider separating the first compartment from the second compartment, the divider comprising a wall including a plurality of openings for placing the first compartment in fluid communication with the second compartment while blocking the passage of aquatic life.

11. The water screen system of claim 10, wherein the openings are formed in a mesh that allows the flow of fluid from the second compartment into the first compartment and blocks the passage of aquatic life from the first compartment into the second compartment.

12. A water screen system, comprising:

a traveling water screen including lift elements;

a high pressure nozzle for applying a high pressure fluid spray to the water screen to release debris from the water screen; and a collection device for collecting aquatic life and debris collected by the water screen, the collection device comprising a first compartment for collecting aquatic life from the lift elements, a second compartment for collecting debris from the water screen released by the high pressure fluid spray, and a filter that is impervious to solids greater than about 3/32" for allowing fluid flow from the second compartment to the first compartment while preventing aquatic life from entering the second compartment from the first compartment.

13. The water screen system of claim 12, wherein the high pressure nozzle is located within the water screen and the collection device is located outside the water screen.

14. The water screen system of claim 12, wherein the collection device is located within the water screen.

* * * * *